United States Patent [19]

Quandt et al.

[11] 4,093,323

[45] June 6, 1978

[54] ROTOR BEARING

[75] Inventors: Gerhard Quandt; Werner Ries, both of Heidelberg, Germany

[73] Assignee: Teldix GmbH, Heidelberg, Germany

[21] Appl. No.: 705,004

[22] Filed: Jul. 14, 1976

[30] Foreign Application Priority Data

Jul. 29, 1975 Germany ..... 2533804

[51] Int. Cl.[2] ..... F16C 32/06

[52] U.S. Cl. ..... 308/121; 308/240; 308/DIG. 15

[58] Field of Search ..... 308/78, 5 R, 92, 106, 308/121, 109, 122, DIG. 15

[56] References Cited

U.S. PATENT DOCUMENTS

| | | | |
|---|---|---|---|
| 3,043,636 | 7/1962 | MacInnes et al. | 308/DIG. 15 |
| 3,393,025 | 7/1968 | Jenkins | 308/132 |
| 3,811,741 | 5/1974 | McInerney et al. | 308/DIG. 15 |
| 4,021,086 | 5/1977 | Rajsigl | 308/189 R |

*Primary Examiner*—Richard A. Bertsch
*Attorney, Agent, or Firm*—Spencer & Kaye

[57] ABSTRACT

In a bearing for the rotor of a rotary device, preferably a spinning turbine, the bearing being composed of an oil-lubricated slide bearing bush and a journal pin connected to the rotor and mounted to the bush for rotation relative thereto, the bush presenting a cylindrical surface providing support for the pin in the radial direction, and elements for yieldingly mounting the bush, there is further provided a bearing mounted to rotate with the rotor and having an axial end face forming, with an axial end face of the bush, an axial slide bearing for the rotor, the axial bearing receiving a supply of lubricating oil during rotation of the device, and a structure defining a narrow annular gap in the vicinity of, and spaced radially outwardly from, the axial slide bearing to provide a constricted region adjacent the axial bearing at which lubricating oil ejected from the axial bearing accumulates.

19 Claims, 5 Drawing Figures

ROTOR BEARING

BACKGROUND OF THE INVENTION

The present invention relates to an arrangement for a rotor bearing, particularly for a rapidly rotating spinning turbine in an open-end spinning machine, of the type including an axial bearing.

It has previously been proposed to provide a bearing arrangement in which the rotor to be mounted has a journal entending into a bearing bush, as disclosed in German patent application No. P 24 27 055.1 and the corresponding, commonly assigned U.S. application Ser. No. 695,551, filed June 14th 1976. It has now been found that sufficient lubricant supply is not always assured for the axial bearing of such an arrangement. The reason for this would appear to be the centrifugal forces encountered as a result of the high rate of rotation, exceeding 40,000 rpm, usually employed in present-day spinning turbines for open-end spinning processes, resulting in ejection of the lubricant out of the axial bearing.

German Offenlegungsschrift [Laid Open Application] No. 2,256,052 discloses a spinning unit in which aerodynamic or aerostatic bearings are provided to support the shaft in the radial or axial direction, respectively. Here, too, the danger exists with respect to the axial bearing that the lubricating medium will be conveyed radially outwardly to a substantial degree so that either large quantities of gas must pass through the bearing or the cost of the bearing manufacturing process is greatly increased due, for example, to the provision of spiral grooves. Moreover, due to the use of pressure plates for the axial bearing, production and assembly of the spinning unit is rather complicated and removal of the spinning unit can be achieved only with difficulty.

SUMMARY OF THE INVENTION

It is therefore an object of the present invention to overcome the above drawbacks and, in a rotor bearing of simple structure and arrangement, to assure sufficient lubricant supplies or avoid excess lubricant throughput. These and other objects according to the invention are achieved, in a bearing for the rotor of a rotary device, the bearing being composed of an oil-lubricated slide bearing bush and a journal pin connected to the rotor and mounted in the bush for rotation relative thereto, the bush presenting a cylindrical surface providing support for the pin in the radial direction, and means for yieldingly mounting the bush, by the improvement including a bearing ring mounted to rotate with the rotor and having an axial end face forming, with an axial end face of the bush, an axial slide bearing for the rotor, the axial bearing receiving a supply of lubricating oil during rotation of the device, and means defining a narrow annular gap in the vicinity of, and spaced radially outwardly from, the axial slide bearing to provide a constricted region adjacent the axial bearing at which lubricating oil ejected from the axial bearing accumulates.

The arrangement according to the present invention is distinguished, in addition by its very simple configuration, mainly by the fact that the axial bearing has associated with it a pressure barrier in the form of an annular gap which can be produced without manufacturing difficulties. Due to the concentric arrangement of the annular gap, the lubricant will accumulate at the cylindrical surface of the annular gap, particularly during rotation at high speeds.

The annular gap is preferably located between the outer surface of the bearing ring and the inner surface of a carrier sleeve which accommodates the bearing bush so that the annular gap can easily be made very narrow. The decisive advantage is that in this way the rotor can easily be removed from the arrangement, which is of particular significance in the spinning art.

It has been found to be advantageous to arrange the bearing bush and the carrier sleeve in a closed housing with non-contacting helical and gap seals being provided at the side of the support arrangement facing the rotor. Thus it is accomplished that the lubricant introduced into the housing, or into lubricant reservoirs provided in the housing, will be ejected only to a very slight degree or can be supplied to the bearings for long periods of operation.

In an advantageous embodiment, the annular gap has associated with it a conical annular surface or annular groove to collect the ejected lubricant. The diameter of the annular surface is here greater than the diameter of the helical seal provided at that location so that lubricant exiting from the annular gap is thrown by the rotor against the annular surface and is kept away from the helical seal.

In order to obtain good circulation of the lubricant within the housing, and thus assure sufficient lubricant supply to the slide bearing surfaces, it is advantageous to provide axial bores in the carrier sleeve and/or in the bearing bush. If the bearing arrangement, or the housing including the rotor, is elastically disposed in a stator, it is advisable to secure it against rotation by means of a pin in the housing, which pin is held in an axial groove of the stator.

It has moreover been found to be very advantageous to design the axial slide bearing as well as the radial slide bearing as known multiple slide surface bearings so that sufficient lubrication of the bearing surfaces and great stability are assured even at high speeds.

Thus a simple and economical arrangement is provided particularly for the spinning industry which is distinguished by surprisingly high operational dependability. The lubricant supply is provided through an axial bore as well as through radial bores in the journal pin. Furthermore, for a journal pin which is oriented with its axis substantially horizontal in the carrier sleeve, a radial bore which extends radially from below toward the end of the journal pin is provided to supply lubricant.

DESCRIPTION OF THE PREFERRED EMBODIMENTS

Figure 1A:
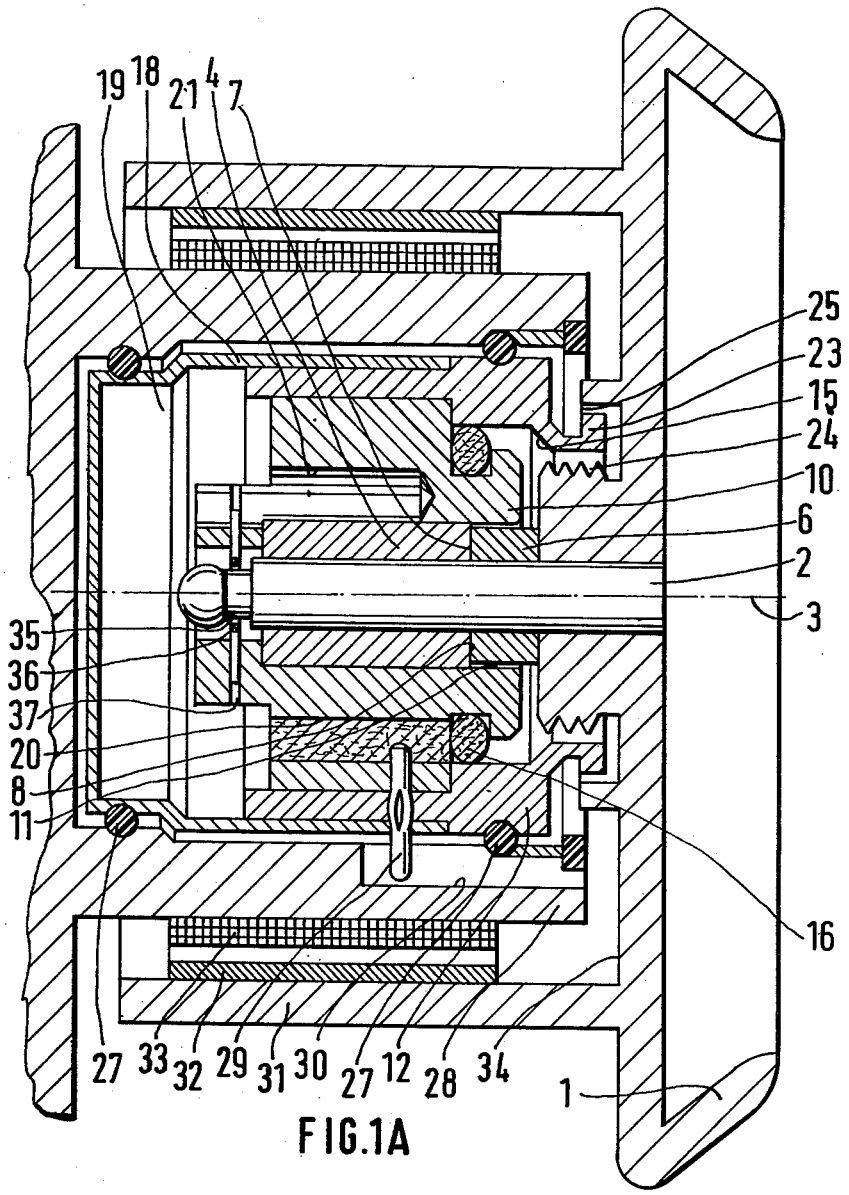
FIG. 1A is a longitudinal cross-sectional view of a spinning rotor equipped with one embodiment of a combined axial, axial-radial slide bearing according to the invention.

In the arrangement shown in FIG. 1A, a rotor in the form of a spinning turbine 1 is mounted by means of a journal 2 to be rotatable about an axis of rotation 3, the journal extending into a cylindrical, stationary bearing bush 4 made of sintered metal. A ring 6 is connected to rotate together with the spinning turbine 1 or with the journal, respectively, and can be a component of the turbine or of the journal, respectively. One frontal face 7 of this ring contacts a frontal face 8 of bearing bush 4 so that the axial slide bearing formed thereby is combined in a simple manner with the above-mentioned radial slide bearing formed by the mating cylindrical surfaces of journal 2 and bush 4.

Bearing bush 4 is disposed inside a carrier sleeve 10 into which ring 6 also extends. The outer diameter of ring 6 is somewhat less than the inner diameter of carrier sleeve 10 so that an annular gap 11 is formed which is concentric with axis of rotation 3. The annular gap can easily be made very narrow, in conformance with the dimensions of the above-mentioned diameters, in order to provide an excellent pressure barrier for the lubricant.

The effect of this barrier is that the lubricant can no longer be ejected directly out of the annular bearing gap as a result of centrifugal forces produced at very high speeds but is rather pressed against the inner cylindrical surface of carrier sleeve 10 and flows from there at a reduced flow speed through the above-mentioned annular gap 11.

The carrier sleeve 10 is disposed in a receiving bush 12 provided with a conical annular surface 15 in the region of its front end which faces the turbine or in the region of ring 6, respectively. Lubricant coming out of the annular gap is collected at the annular surface 15 and conducted to a lubricant reservoir 16 in the form of a ring made preferably of felt or wick.

The receiving bush 12, the carrier sleeve 10 and the bearing bush 4 are disposed within a housing 18 which is sealed at its rear side, facing away from the spinning turbine and there provided with a further reservoir 19. The carrier sleeve 10 is provided with a plurality of axial bores 20 which are filled with wick or felt to permit flow of lubricant from reservoir 16 to reservoir 19. In order to maintain a good lubricant supply to bearing bush 4 which is made of a porous sintered metal, and thus also to the slide bearing surfaces, a plurality of blind bores 21 are disposed at the rear interior surface of the carrier sleeve, or these bores may be through bores with direct connection to annular gap 11.

The conical annular surface 15 is followed toward the front of the unit, i.e. toward rotor 1, by a protrusion 23 of the carrier sleeve 10 at a location where the spinning turbine is provided with a helical seal 24. A further protrusion is provided on the turbine to form a gap 25 with the outer surface of protrusion 23 so that in this way the bearing is excellently sealed without contact. It is of decisive importance in this connection that the diameter of the conical annular surface 15 is greater than the diameter of the helical seal 24, which of course may also be a labyrinth seal.

It is thus assured that lubricant leaving the annular gap 11 will not be ejected directly toward the outside through the rapidly rotating turbine or into the sealing gaps, but will be collected at annular surface 15 and from there is returned to the above-mentioned lubricant reservoirs.

Figure 1B:
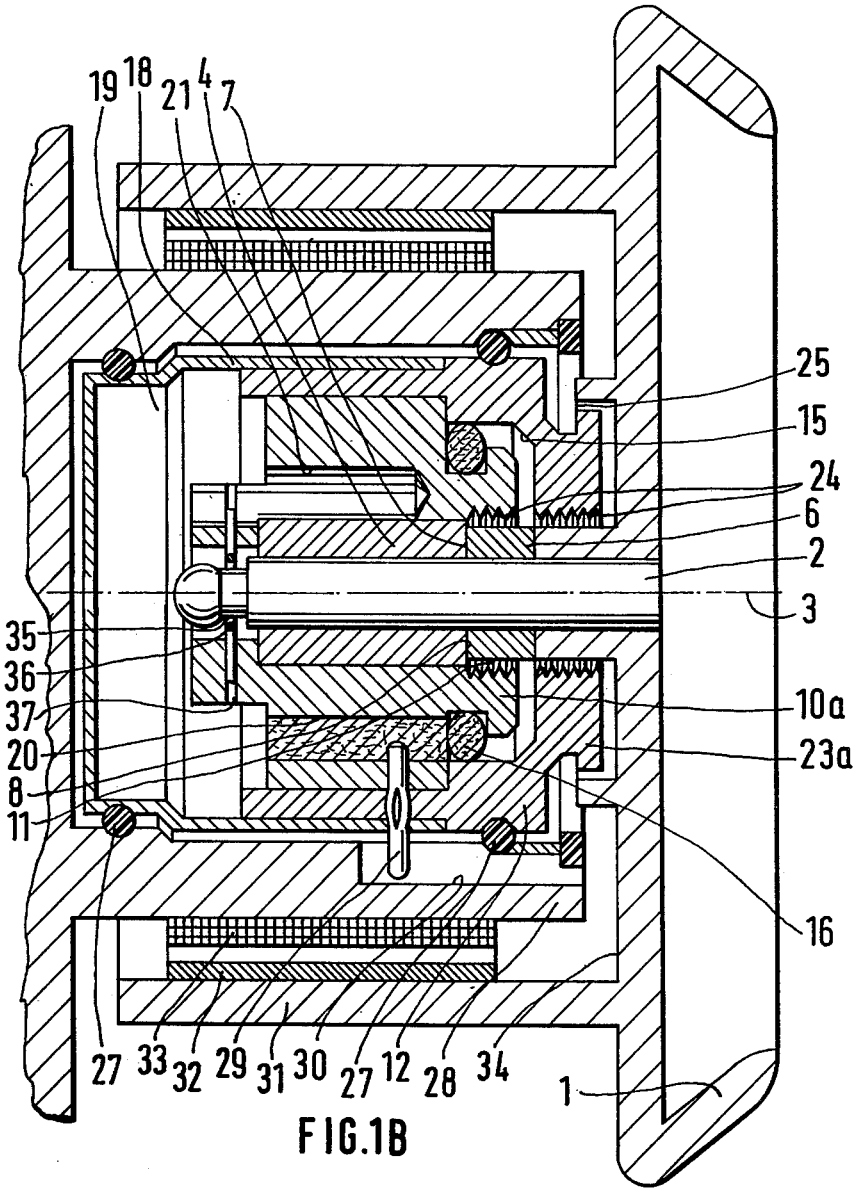
FIG. 1B is a view similar to that of FIG. 1A of a second embodiment according to the invention.

An alternative embodiment is shown in FIG. 1B, where the inner diameter of a protrusion **23*a* is of approximately the same size as the inner diameter of the carrier sleeve 10*a*. In this case the threads of the helical seal are not disposed on the rotor but on the inner surfaces of protrusion 23*a* and carrier sleeve 10*a*. The helical seal works as screw conveyor and transports oil to the bush 4**. It may be constructed as the threads of a screw.

In both embodiments, the entire bearing and thus the rotor are yieldingly arranged in a stator 28 through the intermediary of rings 27 of elastic material. In order to secure the bearing against rotation, a pin 29 is provided which is disposed in radially directed bores of the carrier sleeve 10 or **10*a*, receiving bush 12 and housing 18 and whose free end engages in an axial groove 30** of the stator.

The rotor or the spinning turbine, respectively, is provided with a cup-shaped portion 31 which surrounds stator 28 and which is provided with permanent magnets 32 on its inner cylindrical surface. The permanent magnets together with an electrical winding 33 of the stator form an electrical drive motor which is operated in a known manner as a brushless d.c. motor.

Figure 3:
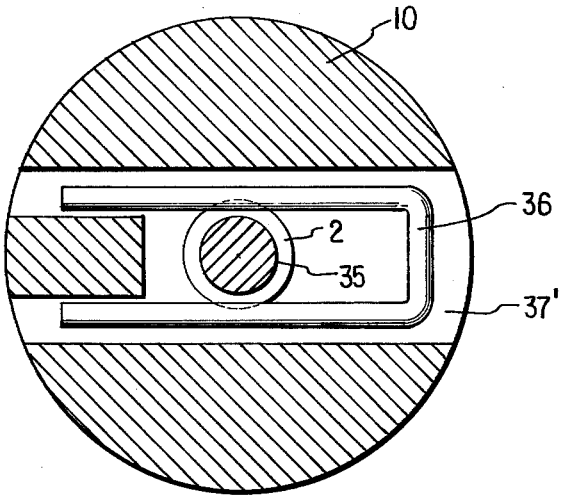
FIG. 3 is a cross sectional view in a plane perpendicular to the pin 2 of FIG. 1A and in the plane of the slots 37 in sleeve 10.

During operation, the axial position of the spinning turbine is fixed by means of frontal faces 7 and 8 of ring 6 and bearing bush 4, respectively, and the subatmospheric pressure developing in the region of the rear surface 34 of the turbine. However, to prevent the turbine from falling out when it is not rotating, the free end of journal pin 2 is provided with an annular groove 35 into which a spring element 36 engages to provide an axial securement. The spring element itself is disposed in slots 37 of the carrier sleeve 10. This can be seen from FIG. 3, where a cross-section in the plane of the slots 37 is shown in part, the slots 37' having here a different construction, the bores 21 are not shown.

Figure 2A:
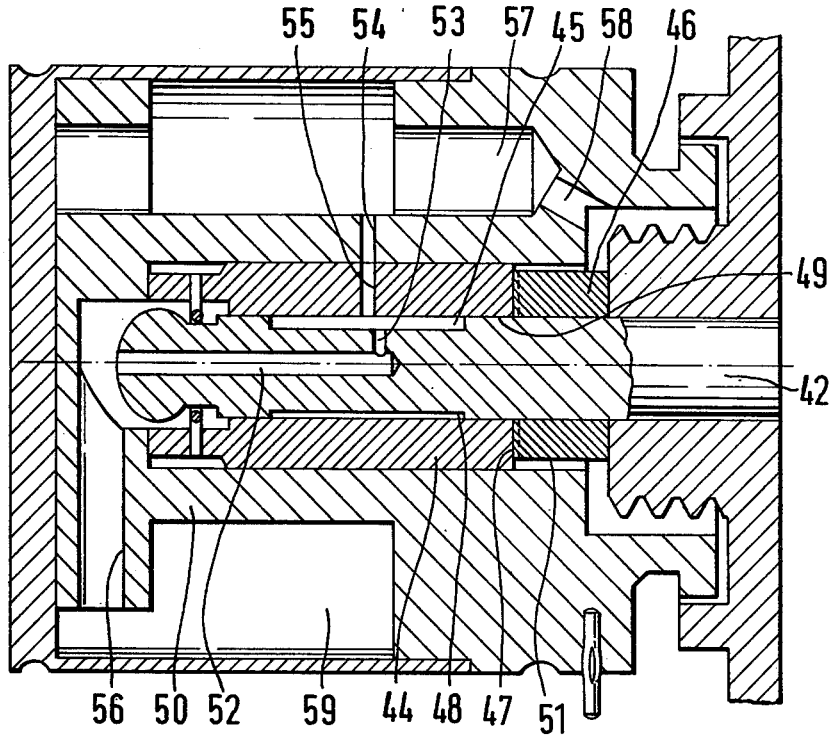
FIG. 2A is a longitudinal, cross-sectional view of another embodiment of a bearing according to the invention.

FIG. 2A shows an arrangement similar to the one described above in which, however, a multiple surface slide bearing is provided as the radial bearing. Such multiple surface bearings with a rigid profile are known to be provided with a plurality of, for example 3, wedge-shaped gaps between the bearing bush and the shaft in which a high lubricant pressure builds up when the shaft is rotating, i.e. a hydrodynamic bearing. Such bearings are excellently suited for high rates of rotation with a stably rotating rotor.

In the embodiment illustrated in FIG. 2A, the inner surface of bearing bush 44 is cylindrical while the radius of journal 42 varies in the peripheral direction, as a result of the provision of pockets 45 and 48 which have respectively different radial depths. The wedge-shaped gaps formed in this manner, however, do not extend over the entire axial length of the journal so that annular bars 49 are provided in the region of the ends of bearing bush 44 to limit the pressure reduction in the axial direction. Three or four pockets may be provided. The extension of the pckets in axial direction may be 50–90% of the length of bush 44; it is to prefer to extend the pockets as long as possible. The maximum depths of the pockets may be for example 0,05 mm when the pin has a diameter of 3 mm.

The lubricant supply is provided through an axial blind bore 52 as well as through radial bores 53 of the journal, the latter being disposed in the areas of the smallest journal radius. For a turbine having a substantially horizontal axis of rotation, it is also very advisable to provide a bore 56 in carrier sleeve 50 which extends vertically from below toward the axis of rotation and through which the lubricant can flow to the end of the journal and thus to the axial blind bore 52.

In the center of the bearing bush 44 and of the carrier sleeve 50, bores 55 and 54, respectively, may be provided, according to another feature of the invention, preferably above journal 42 when the axis of rotation is horizontal. At the front end of the carrier sleeve 50 there is disposed a bore 58 for conducting away the lubricant exiting from annular gap 51. Bore 58 opens into an axial bore 57 via which the lubricant can flow back to an annular lubricant reservoir 59.

Figure 2B:
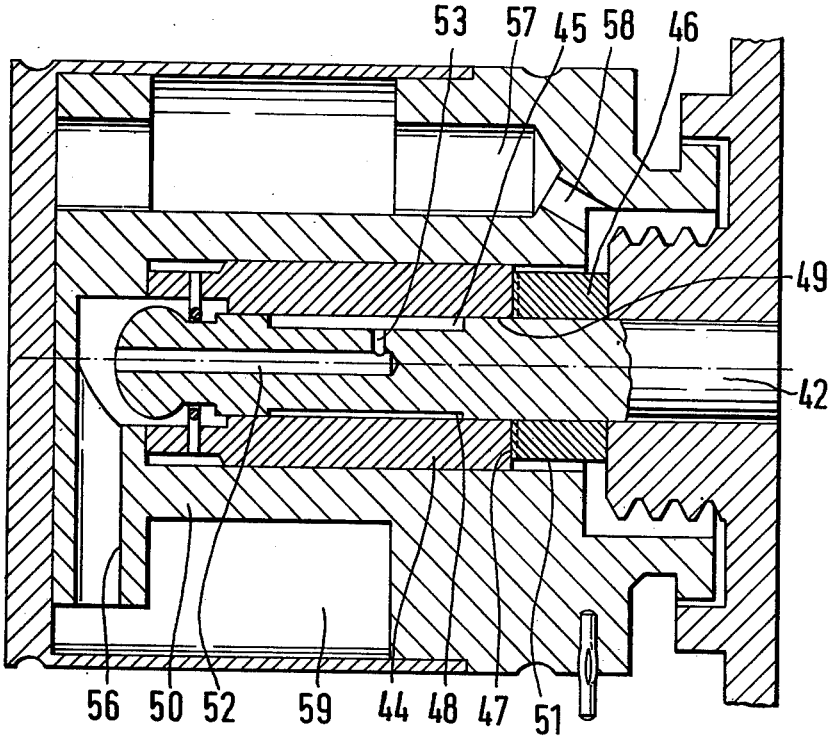
FIG. 2B is a view similar to that of FIG. 2A showing a modified form of construction thereof.

In order to achieve better performance from the axial slide bearing and dependable lubrication of the same, it has been found to be very advantageous to design the acial bearing also as a multiple surface slide bearing, one embodiment of which is shown in FIG. 2B. In this case wedge-shaped gaps are provided on the frontal face 47 of ring 46 whose depth varies in a known manner in the peripheral direction. There may be provided three to six gaps of a maximum depths of for example 0,05 mm and an extension of 1 mm. Here also a bore at the edge of the frontal face of the ring may be provided.

Although the illustrated embodiments relate to spinning turbines, it is expressly pointed out that the invention relates quite generally to bearings of corresponding design.

It will be understood that the above description of the present invention is susceptible to various modifications, changes and adaptations, and the same are intended to be comprehended within the meaning and range of equivalents of the appended claims.

What is claimed is:

1. In a bearing for the rotor of a rotary device, the bearing being composed of an oil-lubricated slide bearing bush and a journal pin connected to the rotor and mounted in the bush for rotation relative thereto, the bush presenting a cylindrical surface providing support for the pin in the radial direction, and means for yieldingly mounting the bush, the improvement comprising: a bearing ring mounted to rotate with the rotor and having an axial end face ring forming, with an axial end face of said bush, an axial slide bearing for the rotor, said axial bearing receiving a supply of lubricating oil during rotation of said device; and means defining a narrow annular gap extending substantially in the axial direction in the vicinity of, and spaced radially outwardly from, said axial slide bearing to provide a constricted region adjacent said axial bearing at which lubricating oil ejected from said axial bearing accumulates.

2. An arrangement as defined in claim 1 wherein said means defining said annular gap include a member connected to said slide bearing surface and having a cylindrical inner surface which, together with the cylindrical outer surface of said bearing ring, delimits said annular gap, said member being at least partly longitudinally coextensive with said bearing ring.

3. An arrangement as defined in claim 2 wherein at least one of said surfaces delimiting said annular gap is provided with conveying grooves arranged for urging lubricating oil passing through the annular gap in the direction toward said axial slide bearing, thereby to increase the back pressure on the lubricating oil in said axial bearing.

4. An arrangement as defined in claim 1 further comprising: a housing in which said bearing bush and said means defining said annular gap are disposed, the interior of said housing being sealed on the side thereof facing away from the rotor; and means at the other side of said housing defining non-contacting seals between the rotor and said housing.

5. An arrangement according to claim 4 wherein a conical annular surface is provided in the region of said annular gap at a non-rotating part for collecting lubricant exiting from said annular gap, and the diameter of said annular surface is greater than the diameter of a following seal.

6. An arrangement as defined in claim 5 further comprising a body of porous material disposed in the vicinity of said annular surface and defining a lubricant reservoir.

7. An arrangement as defined in claim 6 wherein said porous material is constituted by felt.

8. An arrangement as defined in claim 6 wherein the interior of said housing defines, at the side thereof which is sealed, a further lubricant reservoir, and further defines axial bores placing said further reservoir in communication with at least one of said annular surface and said first-recited lubricant reservoir.

9. An arrangement as defined in claim 6 wherein said porous material is constituted by wick.

10. An arrangement as defined in claim 1 further comprising a stator provided with an axial groove, a housing supporting said bearing bush and held in said stator by said means for yieldingly mounting said bush, and a pin held in said housing and having an outer end which engages in said axial groove of said stator to secure said housing against rotation.

11. An arrangement as defined in claim 1 further comprising a carrier sleeve carrying said bearing bush, and wherein said journal pin constitutes the shaft of said rotor and is provided at the end thereof remote from said rotor with an annular groove, and one of said bearing bush and carrier sleeve is provided with slits, and said arrangement further comprises a spring element which engages in said annular groove and said slits so as to limit the axial movement of said rotor.

12. An arrangement as defined in claim 1 further comprising a carrier sleeve carrying said bearing bush and provided with axially directed channels in the region of its inner surface to provide lubricant supply to said bearing bush, and wherein said bearing bush is made of a porous material.

13. An arrangement as defined in claim 12 wherein said bearing bush is made of sintered metal.

14. An arrangement as defined in claim 1 wherein said journal pin constitutes the shaft of said rotor and is provided with an axial bore and at least one radial bore to provide lubricant supply to said cylindrical surface of said bearing bush.

15. An arrangement as defined in claim 14 wherein said journal pin has a varying radius in the peripheral direction to present wedge-shaped gap profiles of a multiple slide surface bearing between said bearing bush and said journal pin.

16. An arrangement as defined in claim 15 wherein said wedge-shaped gap profiles are provided in a region between the axial ends of said bearing bush and said journal pin has a cylindrical surface in the region of the ends of said bearing bush.

17. An arrangement as defined in claim 14 wherein said journal pin is oriented with its axis substantially horizontal, and further comprising a carrier sleeve supporting said bearing bush and provided with a lubricant supply bore in the region of the end of said journal pin remote from said rotor, said bore extending toward said journal pin end.

18. An arrangement as defined in claim 17 wherein said bearing bush and said carrier sleeve together define a unit provided with an outlet bore which is directed substantially vertically upwardly and with a further outlet bore which extends upwardly and is located to conduct away lubricant exiting from said annular gap, and said carrier sleeve is further provided with an axial bore into which said further outlet bore opens.

19. An arrangement as defined in claim 1 wherein said axial slide bearing is formed as a multiple surface slide bearing.

* * * * *